US012798634B2

(12) United States Patent
Davis et al.

(10) Patent No.: US 12,798,634 B2
(45) Date of Patent: Nov. 17, 2026

(54) MATERIAL HANDLING MACHINE FOR USE WITH OPEN TOP RAIL CARS

(71) Applicant: Herzog Railroad Services, Inc., St. Joseph, MO (US)

(72) Inventors: Timothy D. Davis, St. Joseph, MO (US); Tyler Austin Mejia, St. Joseph, MO (US); Steven R. Walton, Olathe, KS (US)

(73) Assignee: Herzog Railroad Services, Inc., St. Joseph, MO (US)

( * ) Notice: Subject to any disclaimer, the term of this patent is extended or adjusted under 35 U.S.C. 154(b) by 356 days.

(21) Appl. No.: 18/664,931

(22) Filed: May 15, 2024

(65) Prior Publication Data

US 2024/0383509 A1 Nov. 21, 2024

Related U.S. Application Data

(60) Provisional application No. 63/503,117, filed on May 18, 2023.

(51) Int. Cl.
*B61F 13/00* (2006.01)
*B61F 5/02* (2006.01)

(52) U.S. Cl.
CPC ..... *B61F 13/00* (2013.01); *B61F 5/02* (2013.01)

(58) Field of Classification Search
CPC ..... B60B 33/0042; B61F 5/02; B61F 13/00
See application file for complete search history.

(56) References Cited

U.S. PATENT DOCUMENTS

| | | | | |
|---|---|---|---|---|
| 1,787,131 | A | 12/1930 | Underwood | |
| 1,807,793 | A | 6/1931 | Moore | |
| 2,135,307 | A | 11/1938 | Keator | |
| 2,541,514 | A * | 2/1951 | Herold | B60B 33/0042 16/48 |
| 4,096,954 | A | 6/1978 | Buckner | |
| 4,099,635 | A | 7/1978 | Leonard et al. | |
| 4,241,811 | A | 12/1980 | Buckner | |
| 4,829,907 | A | 5/1989 | Theurer et al. | |
| 4,830,562 | A | 5/1989 | Frederking | |
| 5,037,264 | A | 8/1991 | Lloyd | |
| 5,289,778 | A * | 3/1994 | Romine | B61B 15/00 105/72.2 |
| 5,527,144 | A | 6/1996 | Herzog et al. | |
| 6,012,396 | A * | 1/2000 | Schulz | B61B 15/00 105/215.1 |

(Continued)

*Primary Examiner* — S. Joseph Morano
*Assistant Examiner* — Maxwell L Meshaka
(74) *Attorney, Agent, or Firm* — AVEK IP, LLC; Kent R. Erickson

(57) ABSTRACT

A wheel and tire assembly for material handling machines for selective operation on or off rails include a monolithic, tubular wheel body divided into an inner tire mounting section and an outer rail engaging section. The tire mounting section is bounded by an inner rim projecting around an inner end of the wheel body and an outer rim projecting radially outward around the wheel body medially between the inner and outer ends thereof. A tire is securable around the wheel between the inner and outer rims. A rail engaging flange projects radially outward from the wheel body in outwardly spaced relation from the outer rim in a spacing adapted for reception of a rail, such as a rail formed on an upper end of a rail car sidewall therebetween.

17 Claims, 11 Drawing Sheets

(56) References Cited

U.S. PATENT DOCUMENTS

| | | | | |
|---|---|---|---|---|
| 6,324,994 | B1 * | 12/2001 | Glenn | B62M 6/75 105/72.2 |
| 6,490,980 | B1 * | 12/2002 | Mosby | B62D 53/04 105/397 |
| 6,561,742 | B1 | 5/2003 | Crawford et al. | |
| 7,077,065 | B2 * | 7/2006 | Tremblay | B60B 19/02 105/72.2 |
| 7,156,603 | B2 | 1/2007 | Marcotte | |
| 7,686,561 | B2 * | 3/2010 | Smith | B66C 13/18 414/339 |
| 7,975,618 | B2 | 7/2011 | Bullis | |
| 8,393,846 | B1 | 3/2013 | Coots | |
| 8,459,924 | B1 | 6/2013 | Coots | |
| 8,636,460 | B1 * | 1/2014 | Coots | E02F 9/022 414/394 |
| 9,096,235 | B2 * | 8/2015 | Kissel | E01B 25/28 |
| 2001/0050026 | A1 * | 12/2001 | Esposito | B60F 1/02 105/215.2 |
| 2004/0250724 | A1 * | 12/2004 | Sobolewski | B60L 13/04 105/215.1 |
| 2007/0089637 | A1 * | 4/2007 | Sproat | B61D 3/184 105/72.2 |
| 2007/0297882 | A1 | 12/2007 | Villar et al. | |
| 2010/0294848 | A1 * | 11/2010 | Bullis | B60B 17/0072 188/41 |
| 2016/0319513 | A1 | 11/2016 | Chen et al. | |
| 2022/0267982 | A1 | 8/2022 | Geiger | |
| 2024/0383509 | A1 * | 11/2024 | Davis | B61F 13/00 |

* cited by examiner

MATERIAL HANDLING MACHINE FOR USE WITH OPEN TOP RAIL CARS

CROSS-REFERENCE TO RELATED APPLICATIONS

This application claims the benefit of U.S. Provisional Patent Application No. 63/503,117, filed May 18, 2023, the disclosure of which is hereby incorporated herein in its entirety by reference.

BACKGROUND OF THE INVENTION

Field of the Invention

This invention relates to a material handler for the loading or unloading of an open top railroad car, such as a gondola car. More specifically, the invention relates to an excavator type machine mounted on an undercarriage having wheels adapted to travel along the tops of the sidewalls of an open top railroad car and unload material from or load material into a well of the rail car.

Description of the Related Art

Backhoes and excavators have been modified to permit the equipment to be supported on and travel along the tops of sidewalls of open top rail cars including gondola cars and operated to load or unload the contents of the rail cars. Backhoe or excavator type unloaders or other material handling machines having an upper body and boom that rotates 360 degrees relative to an undercarriage, provide considerable flexibility for an operator in precisely positioning materials unloaded form the rail cars. U.S. Pat. No. 6,561,742 to Crawford and Ross and assigned to Herzog Contracting Corp. discloses front and rear support bracket assemblies connectable to a tracked excavator to support the excavator on the upper sidewalls of open top rail cars. U.S. Pat. No. 5,527,144 to Herzog et al. discloses a backhoe style unloader or material handling machine with attachments to prevent the backhoe from inadvertently advancing off the side of the rail car. U.S. Pat. No. 7,686,561 discloses an excavator style material handler with an upper body rotatably mounted on an undercarriage supported on tracks. U.S. Patent Application Publication No. 2022/0267982 A1 of Geiger and US Patent Application Publication No. US 2016/0319513 A1 of Chen et al disclose walking type excavators with four walking legs pivotably connected to an undercarriage of the excavator.

Due to the size of existing excavator type, rail car loading and unloading equipment, the excavator must be loaded or load itself onto a consist of rail cars on a section of track along which material is to be loaded or unloaded. Existing excavator style unloaders will not fit within a dimensional envelop or clearance diagram set by the American Association of Railroads to ensure the rail cars and their contents or equipment operating thereon clears obstructions above or along a track or accommodates rail cars passing on adjacent tracks.

There remains a need for improvements to material handling machines to facilitate movement of wheeled material handling machines along the upper sidewalls of open top rail cars. There also remains a need for such a material handling machine which can fit within a clearance diagram for clearances along the railroad. There is also a need for such a material handling machine that can be stored within the well of an open top rail car with which it is used without having to use additional equipment or ramps.

SUMMARY OF THE INVENTION

A wheel and tire assembly securable to a rotating hub of a wheel base is disclosed which is adapted for mounting on a material handling machine to facilitate movement of the material handling machine along the upper sidewalls of open top rail cars. The wheel and tire assembly may include a tire and a tubular wheel body. The tire includes a tread and first and second tire sidewalls. The first and second tire sidewalls each have an inner edge circumscribing a tire opening extending through the first and second tire sidewalls. The wheel body comprises a tubular wheel body wall having a first end and a second end. The tire is securable to and around the wheel body with the tubular wheel body wall extending through the tire opening. The wheel body further includes a rail engaging flange projecting radially outward relative to the wheel body wall in outwardly spaced relation from the tire in a spacing adapted for reception of a rail therebetween such as the upper end of the sidewall of an open topped rail car. The tubular wheel body wall is preferably formed as a single piece and the tire is secured to and around the wheel body between a first rim and a second rim. The wheel and tire assembly may be adapted for securement to a wheel base having a wheel mounting flange projecting radially outward from the rotating hub of the wheel base and the wheel and tire assembly includes a wheel body mounting flange projecting inward from the wheel body wall between the first end and the second end thereof and the wheel body mounting flange is removably securable to the wheel mounting flange of the rotating hub.

The wheel and tire assembly may be used in combination with a walking type material handling machine having four jointed legs with each jointed leg having a wheel drive assembly mounted on a distal end thereof and with each wheel drive assembly including a hub rotatably mounted on the respective jointed leg and one of the wheel and tire assemblies is attached to the hub of each wheel drive assembly. Each of the wheel and tire assemblies is attached to the hub of a respective wheel drive assembly such that the first end of the wheel body extends toward the respective jointed leg to which the respective wheel drive assembly is attached and the second end of the wheel body extends away from the respective jointed leg. The walking type material handling machine may be of a type having four jointed legs pivotably connected to an undercarriage having a power and control unit rotatably mounted on the undercarriage and an articulated arm pivotally connected to the power and control unit with the power and control unit with the arm attached thereto rotatable 360 degrees relative to the undercarriage. A variety of tools may be interchangeably attached to the articulated arm or boom.

The material handling machine with the wheel and tire assemblies mounted on each leg is adapted for use in combination with a consist of open topped rail cars wherein upper ends of the sidewalls of the open topped rail cars form rails which extend between the rail engaging flange and the tire secured to the wheel body of each wheel and tire assembly as the wheel and tire assembly is advanced across the upper ends of the sidewalls. Open topped rail cars with which the material handling machine may be used may include hopper cars and gondola cars.

In one application, the tire and wheel assemblies may be used with a walking type excavator having four walking legs pivotably connected to the undercarriage with each leg pivotable generally vertically relative to the undercarriage about a first axis and generally laterally relative to the undercarriage about a second axis. The tire and wheel assemblies may be mounted on planetary drives or wheel drive assemblies mounted on the end of each arm. An operator can operate the walking legs independently in combination with the boom to lift the material handling machine up onto an open topped rail car and then independently operate the walking legs and boom to lower the material handling machine into the enclosed space of the open topped rail car to fit within the dimensional envelope or clearance diagram set by the American Association of Railroads. Each walking leg may be retracted laterally a sufficient distance to allow the outer edges of each wheel to fit within the sidewalls of the rail car.

DETAILED DESCRIPTION OF THE PREFERRED EMBODIMENTS

Figure 1:
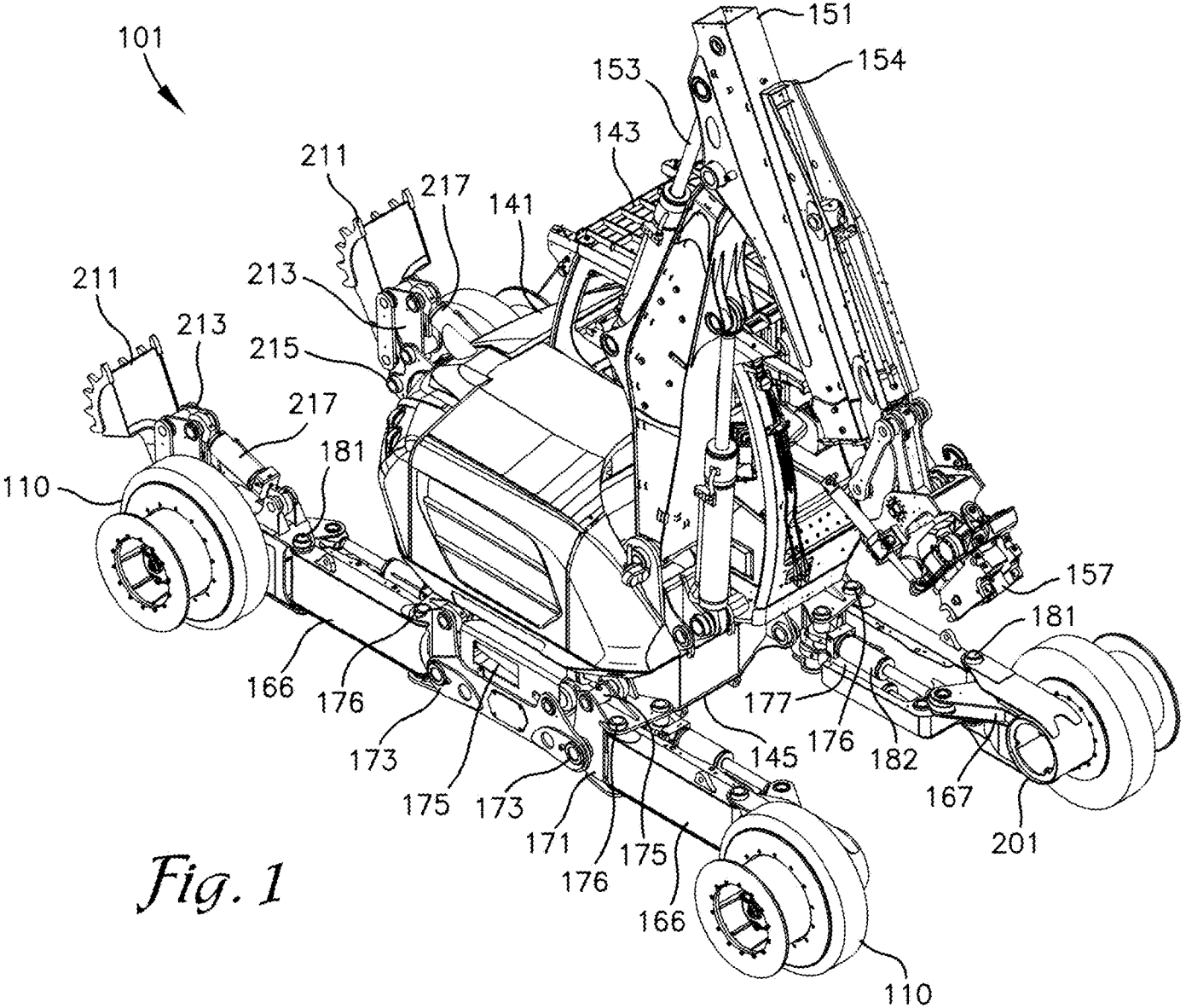
FIG. 1 is a perspective view of a walking-type material handling machine having wheel and tire assemblies mounted thereon which are adapted for traveling on and off of rails.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings, and in particular FIGS. 1-7, reference numeral 101 designates a multi-purpose, material handling machine 101, in the nature of a walking type excavator or unloader adapted for use in selectively traveling on and across a road or the ground or across a consist 102 of open top rail cars 103. The embodiment of the material handling machine 101 shown is particularly adapted for use with open topped rail cars 103 or a consist 102 of open topped rail cars 103 incorporating or used with a variety of primary automated material handling systems in which an auxiliary material handling machine 101 might be used to supplement the material handling capabilities of the primary material handling systems or clear jams of material fed into or through such primary automated material handling systems.

In one application, and as shown in FIGS. 4-7, the open topped rail cars 103 each comprise a car frame 106 supported on trucks 107 and a car body 108 disposed thereon. The car body 108 includes sidewalls 109 and end walls 111 substantially enclosing an interior space 113 above a bottom or floor 115 of the rail car 103. Upper ends 117 of the sidewalls 109 may be formed from rigid square metal tubing and may function as rails 117 adapted to support a flanged wheel of a vehicle to facilitate traversal thereacross. The material handling machine 101 is adapted for use with other types of open top rail cars including hopper cars or gondola cars and for unloading from or loading into open top rail cars a wide variety of materials. It is foreseen that one or a plurality of material handling machines 101 may be used with a consist 102 of rail cars 103 depending on the amount of work to be performed and the time frame in which the work is to be completed.

In the embodiment shown in FIGS. 4-7, some of the open topped rail cars 103 are equipped with rail tie singulating and discharge equipment 120 adapted to singulate and discharge individual rail ties 122 from a stack 124 or rail ties 122 supported on a conveyor (not shown) on the bottom 115 of the rail car 103. The consist 102 also includes a material handler storage car 130 configured for storing the material handling machine 101 when not in use and when moving the consist 102 under conditions in which the material handling machine must be lowered to fit within the dimensional envelope 125 or clearance diagram set by the American Association of Railroads.

The material handling machine 101 shown is of a type which may be referred to as a walking excavator 101 having a set of modified wheel and tire assemblies 110 mounted thereon to facilitate movement of the material handling machine 101 along the upper ends 117 of the sidewalls 109 of the open topped rail car 103. The walking excavator 101 may be of the type shown in US Patent Application Publication No. US 2022/0267982 A1 of Geiger or US Patent Application Publication No. US 2016/0319513 A1 of Chen et al. the disclosures of which are incorporated herein by reference. It is foreseen that the wheel and tire assemblies 110 disclosed could be used with other types of material handling machines such as non-walking type excavators or the like.

Figure 2:
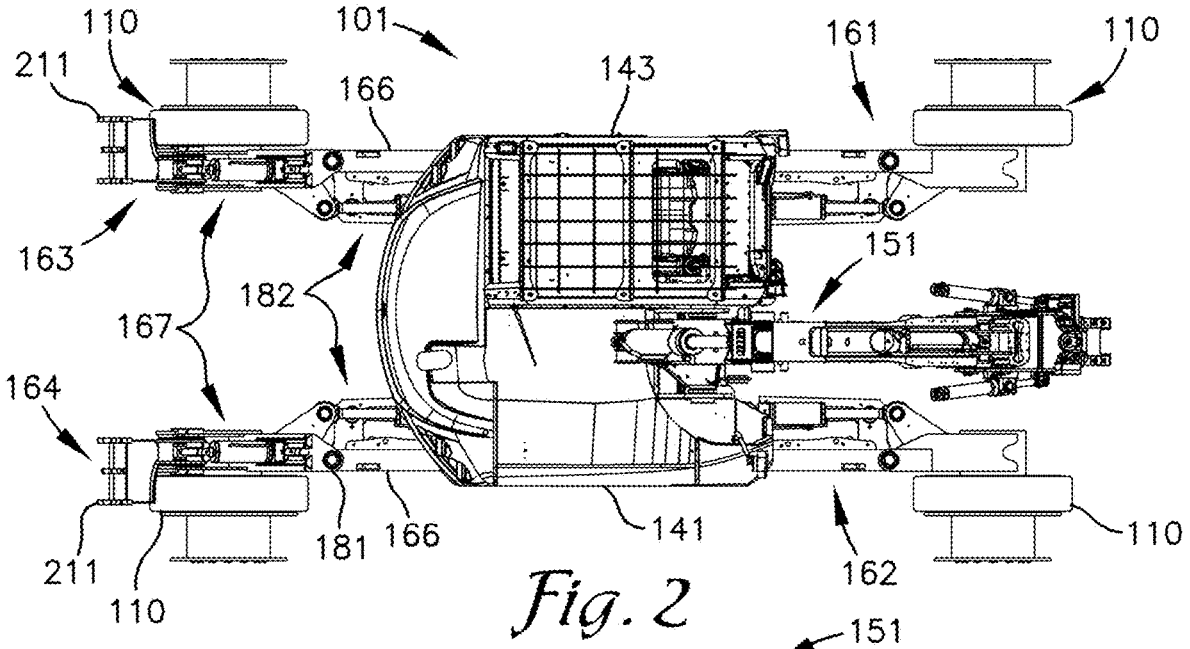
FIG. 2 is a top plan view of the material handling machine as in FIG. 1.
Figure 3:
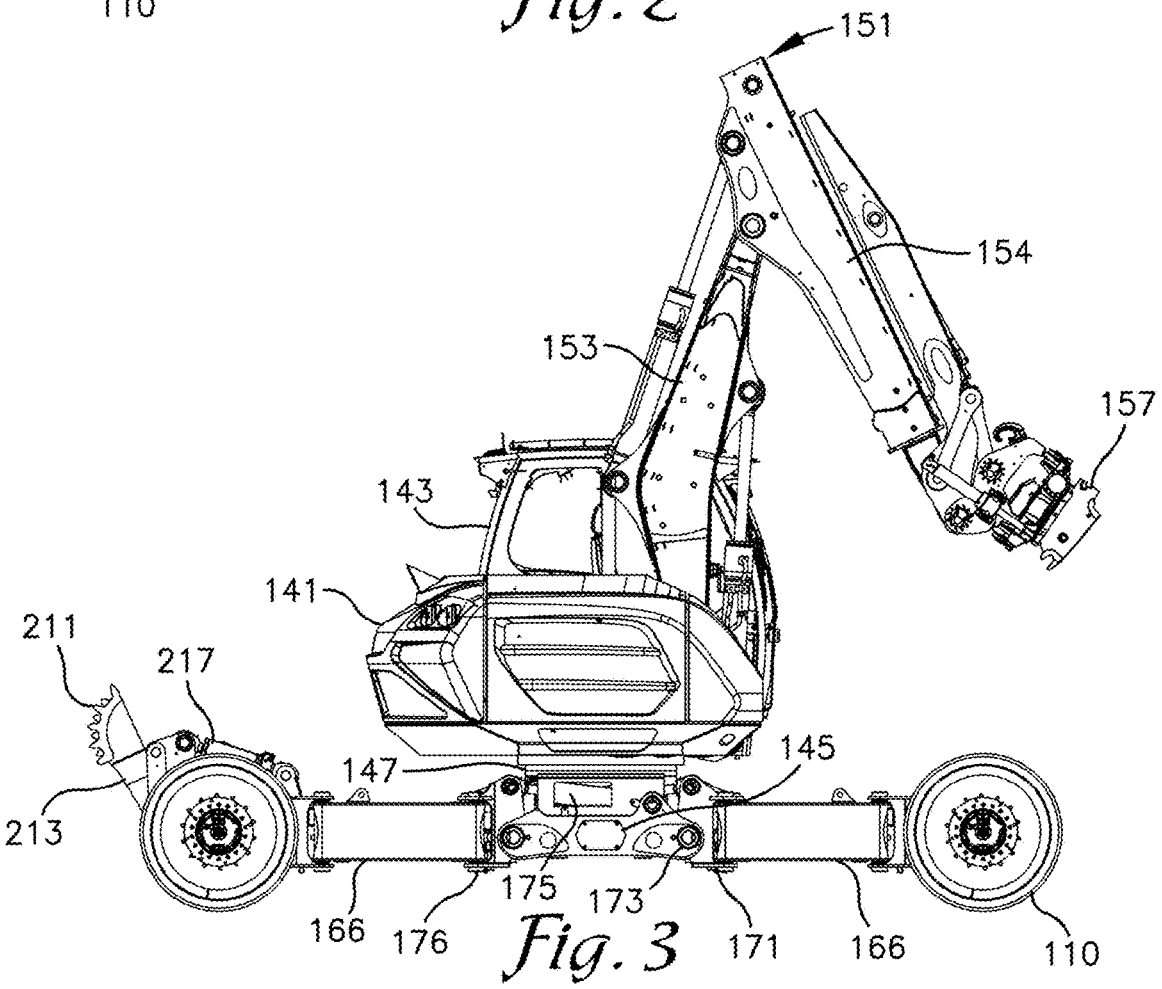
FIG. 3. is a side elevational view of the material handling machine as in FIG. 1.
Figure 4:
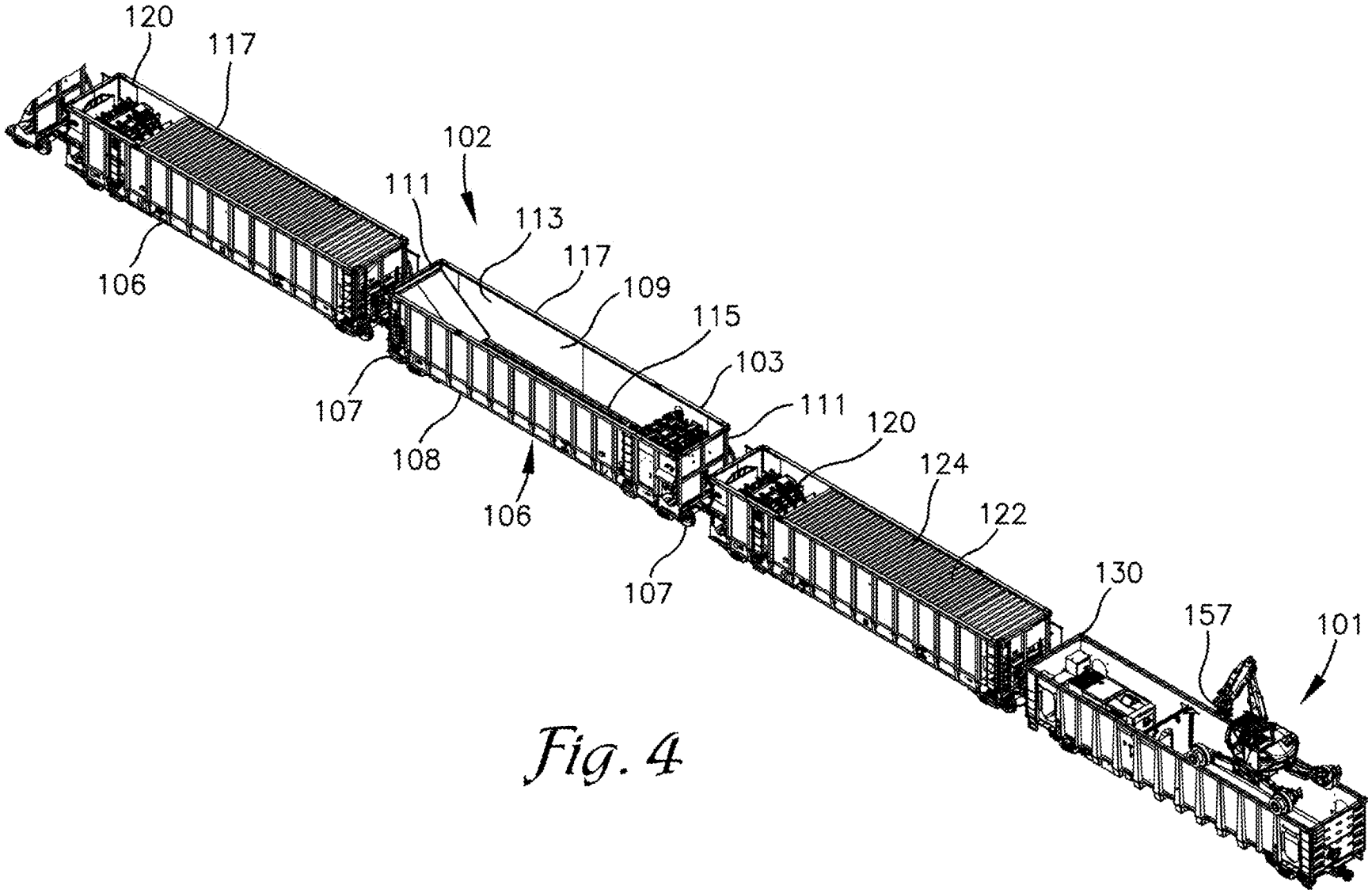
FIG. 4 is a fragmentary, perspective view of a consist of rail cars comprising open top rail cars with a walking-type material handling machine of the type shown in FIG. 1 supported on one of the open top rail cars configured as a material handler storage car.
Figure 12:
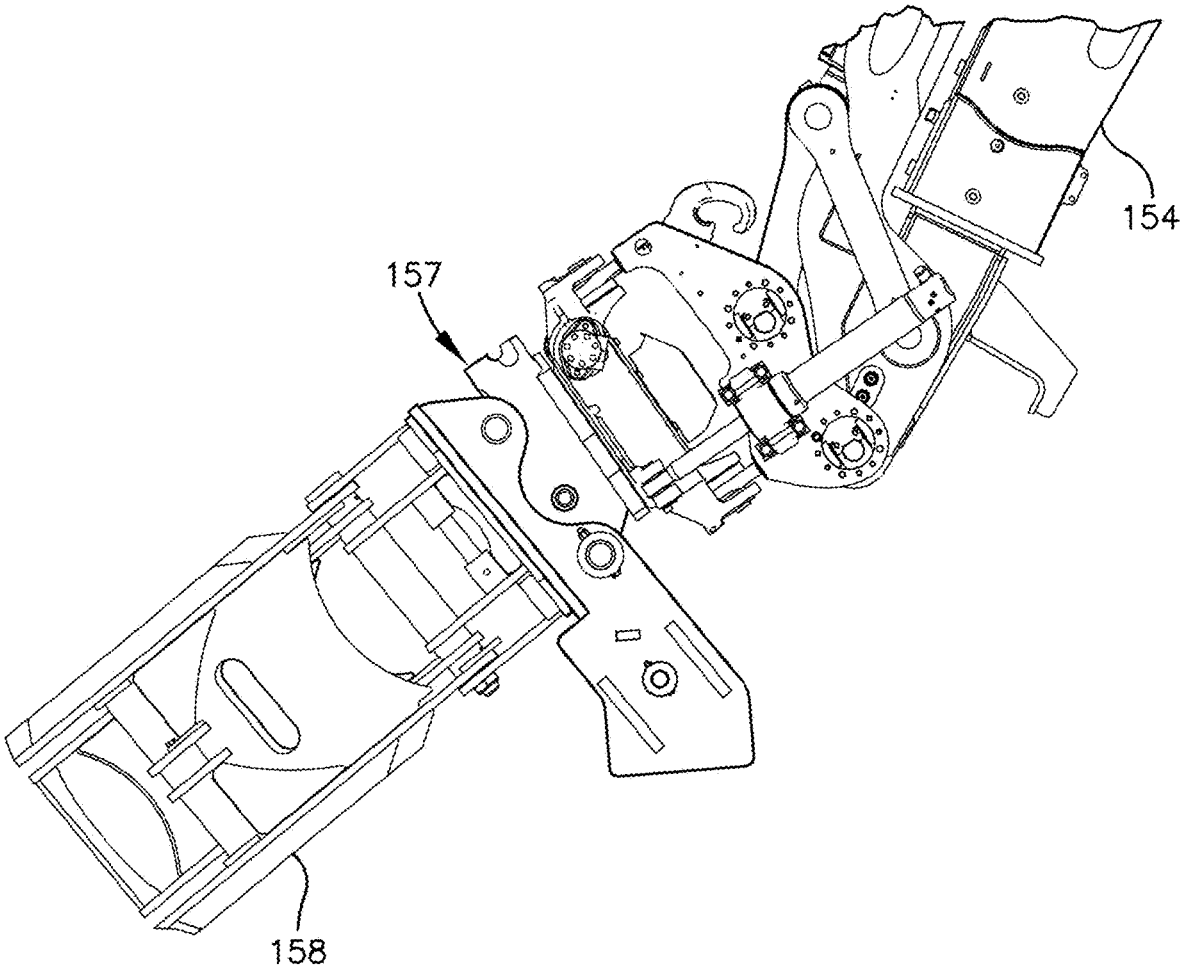
FIG. 12 is a fragmentary and enlarged side view of an articulated arm of the material handling machine with a grapple type tool removably coupled to a tool coupler on the end of the articulated arm.

As best seen in FIGS. 1-3, the walking type, material handling machine 101 includes a superstructure or power and control unit 141 which may include a cab 143 and which is rotatably mounted on an undercarriage 145 via a turntable 147 which permits the power and control unit 141 to rotate 360 degrees relative to the undercarriage 145. An articulated boom 151 is connected to and its operation is controlled through the power and control unit 141. The boom 151 shown is formed from inner and outer boom or arm segments 153 and 154. Inner boom segment 153 is pivotally connected at a first end to the power and control unit 141 and at a distal end to an inner end of the outer boom segment 154. A tool coupler 157 (see FIGS. 3 and 5), is pivotally connected to the distal end of outer boom segment 154. The tool coupler 157 is adapted for selectively and releasably securing a variety of tools to the distal end of the outer boom segment 154 to facilitate movement of the tool relative to the outer boom segment 154. FIG. 12 shows a tool 158, comprising a grapple, coupled to the tool coupler 157. Operation of the tool 158 may be controlled by an operator using controls located in the cab 143 or remotely.

The undercarriage 145 of the material handling machine 101 is supported on four hinged or jointed leg assemblies 161, 162, 163 and 164. As best seen in FIG. 2, the hinged leg assemblies may be designated left and right, front hinged leg assemblies 161 and 162 respectively and left and right, rear hinged leg assemblies 163 and 164 respectively. A wheel and tire assembly 110 is rotatably mounted on and may be considered part of each hinged leg assembly 161, 162, 163 and 164.

Each hinged leg assembly includes an inner leg segment 166 and distal leg segment 167 hingedly connected together. The inner leg segment 166 is hingedly or pivotably connected to a corner of the undercarriage 145 by a hinge base 171. A lower end of the hinge base 171 is pivotably connected to the associated corner of the undercarriage 145 by a first pivot pin or pivot connection 173 having a generally horizontally extending pivot axis extending laterally outward relative to the undercarriage 145 and perpendicular relative to a plane extending longitudinal through the center of the undercarriage 145 of the material handling machine 101. A first actuator 175 mounted on the undercarriage 145 and connected at a distal end to an upper portion of the hinge base 171 is extendable and retractable to pivot the hinge base 171 downwardly and upwardly about the horizontal pivot axis through the first pivot connection 173.

An inner end of the inner leg segment 166 is pivotably connected to the hinge base 171 by a second pivot pin or pivot connection 176 having a vertical pivot axis extending transverse to the horizontal pivot axis of the first pivot connection 173 and generally vertically when inner leg segment 166 extends horizontally outward relative to the undercarriage 145. A second actuator 177 is connected between a distal portion of the inner leg segment 166 and the hinge base 171 and is extendable and retractable to pivot the inner leg segment 166 about the vertical pivot axis extending through the second pivot connection 176 and generally outward and inward relative to the longitudinal plane through the undercarriage 145. Extension and retraction of the first actuator 175 pivots the inner leg segment 166 attached to the hinge base 171 downward and upward about the horizontal pivot axis through the first pivot connection 173.

An inner end of the distal leg segment 167 of each hinged leg assembly 161-164 is pivotably connected to a distal end of each inner leg segment 166 by a third pivot pion or pivot connection 181 having a vertical pivot axis extending parallel to the vertical pivot axis extending through the second pivot connection 176 and generally vertically when inner leg segment 166 extends horizontally outward relative to the undercarriage 145. A third actuator 182 is connected between the inner leg segment 166 and the distal leg segment 167 and is extendable and retractable to pivot the distal leg segment 167 about the vertical pivot axis extending through the third pivot connection 181 and generally outward and inward relative to the inner leg segment 166.

Figure 8:
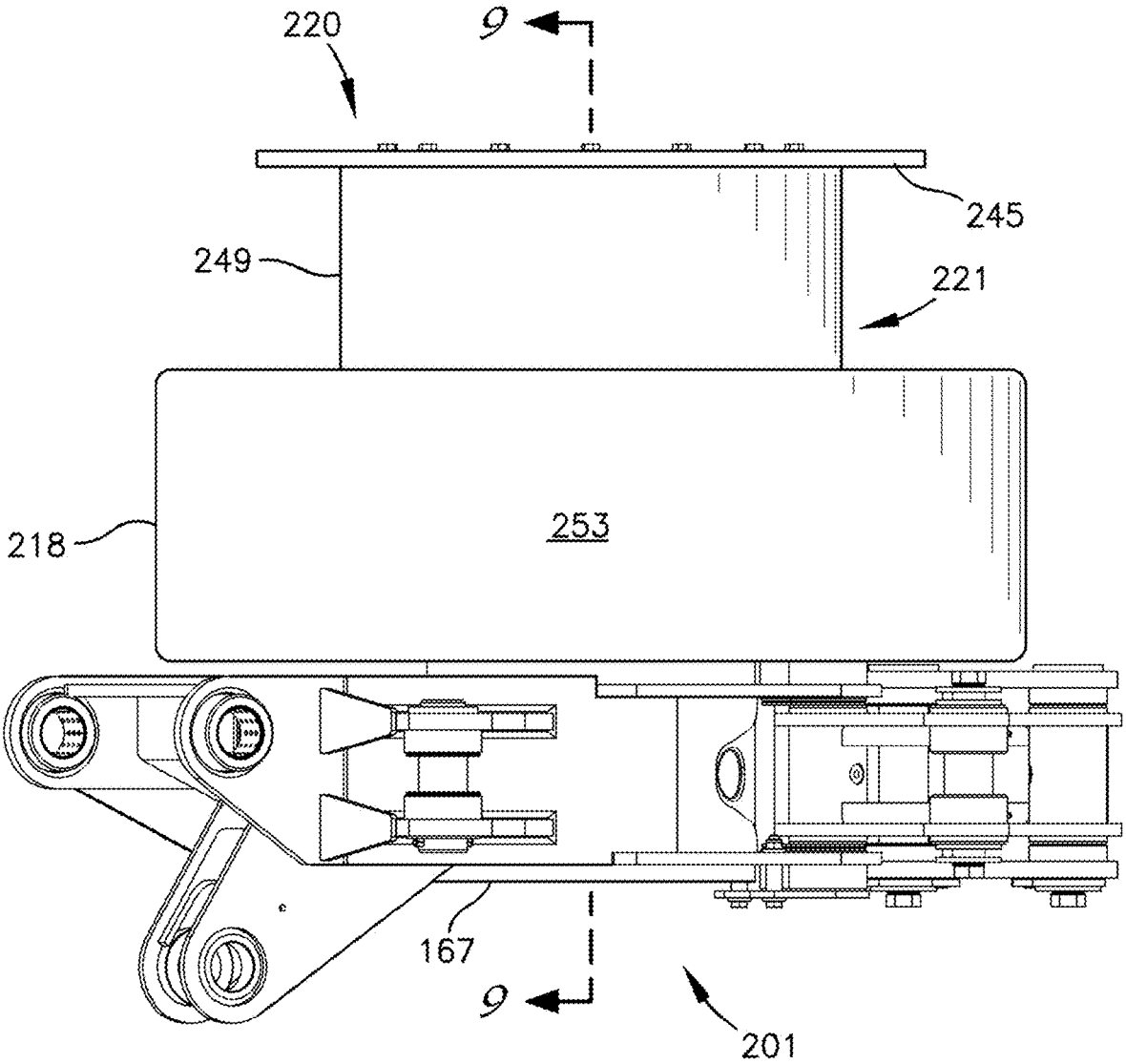
FIG. 8 is a plan view of one of the wheel and tire assemblies mounted on a segment of one of the arms of the walking-type material handling machine.
Figure 9:
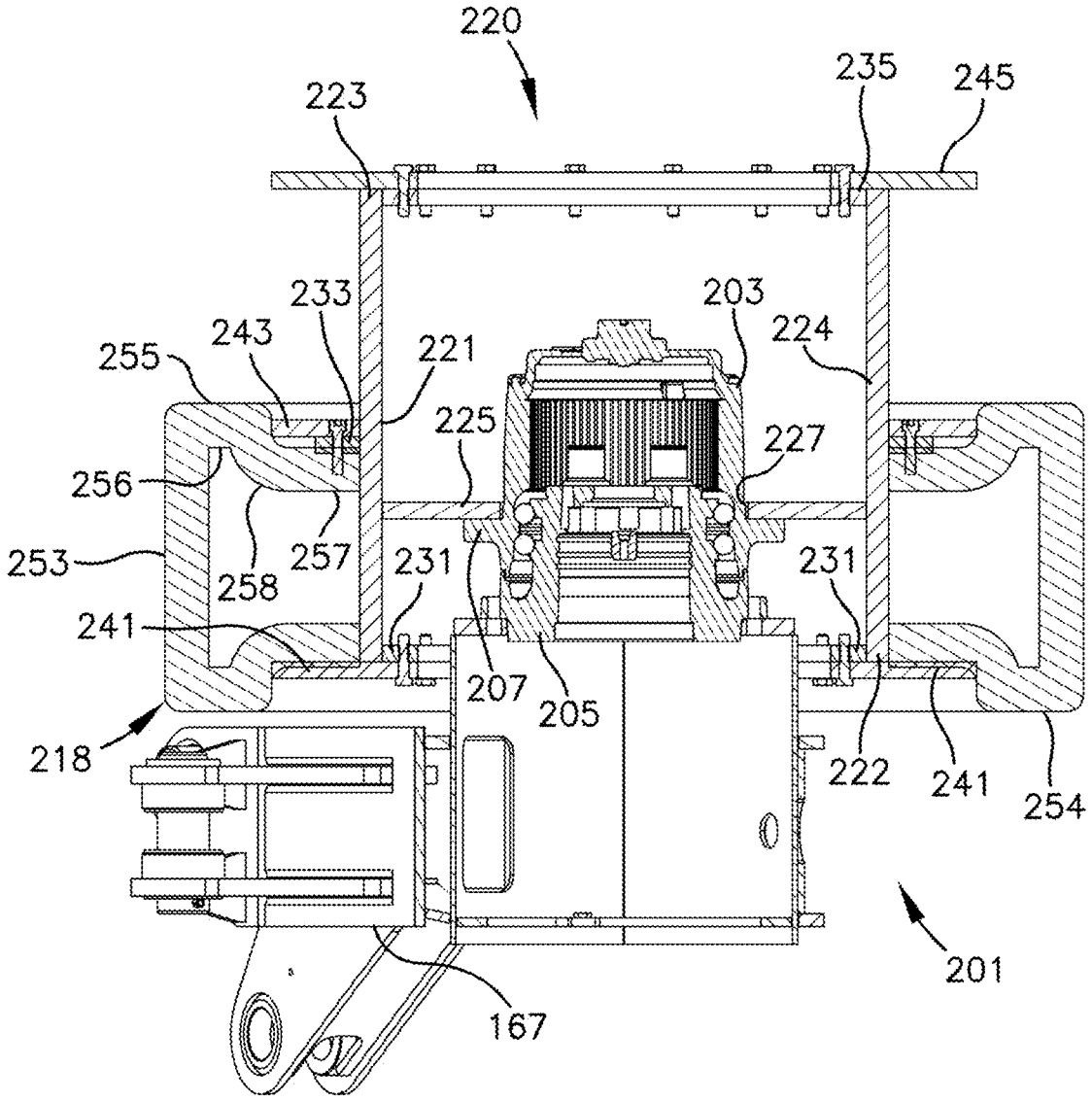
FIG. 9 is a cross-sectional view of the wheel and tire assembly taken generally along line 9-9 of FIG. 8.
Figure 10:
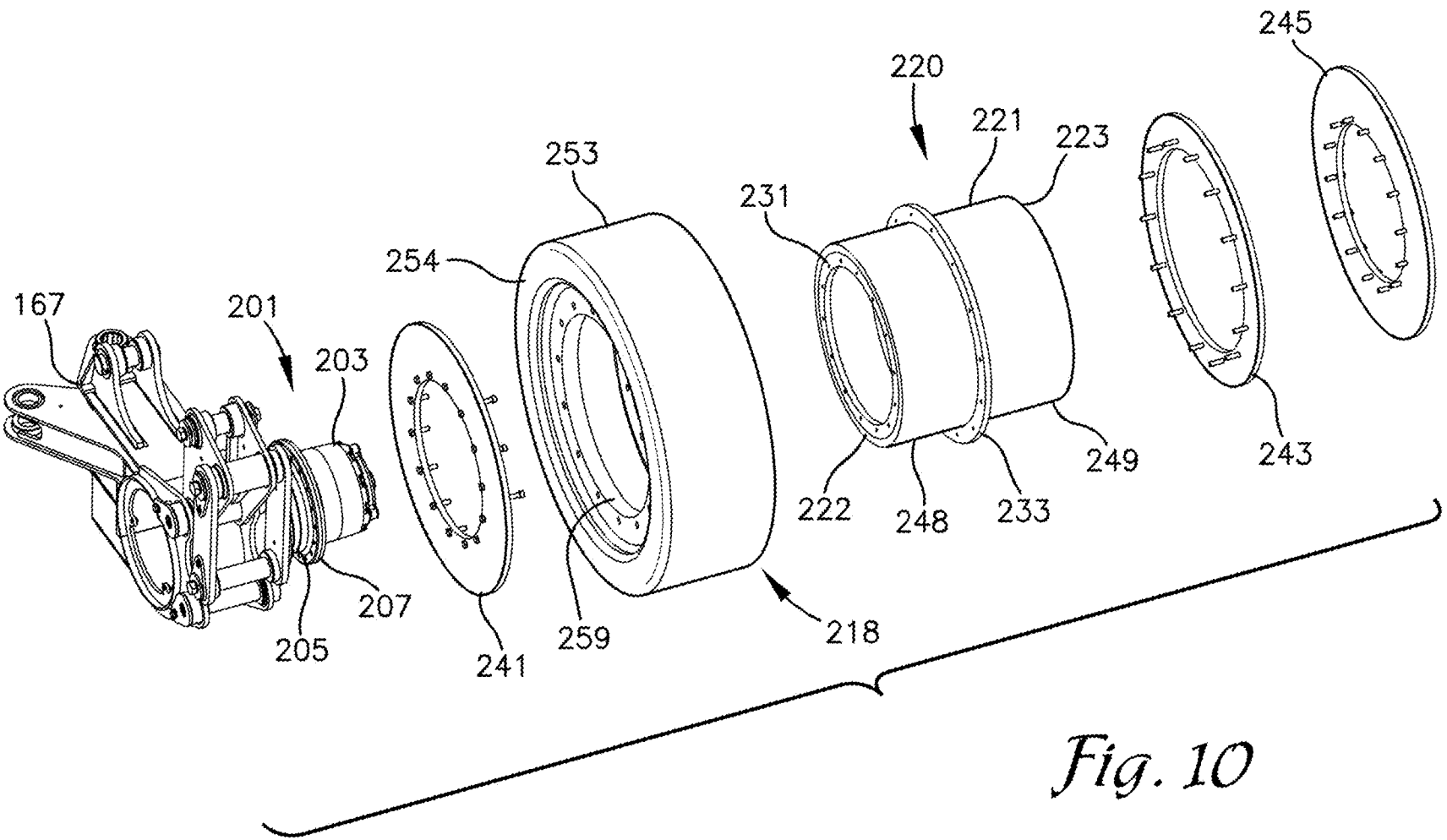
FIG. 10 is an exploded perspective view of the wheel and tire assembly connected to the arm segment as in FIG. 8.

As best seen in FIGS. 8-10, a hydraulically powered, wheel drive assembly 201 is mounted on and extends transverse to each of the distal leg segments 167 of hinged leg assemblies 161-164. With particular reference to FIGS. 9 and 10, each wheel drive assembly 201 includes a rotating hub 203 rotatably mounted on a wheel drive base 205. Wheel drive base 205 may also be referred to as wheel base 205. A wheel mounting flange 207 projects radially outward from the rotating hub 203. Mounting holes, not shown, are formed through the wheel mounting flange 207 for use in bolting an inwardly projecting mounting flange of a conventional wheel (not shown) thereto.

In the embodiment of the material handing machine 101 shown, the left and right hinged leg assemblies 163 and 164 each have a gripping pad or foot 211 mounted on the distal end of a third leg segment 213 pivotally connected to a distal end of the second leg segment 167 by a fourth pivot pin or pivot connection 215. The pivot axis through the fourth pivot connection 215 extends generally horizontally through the distal end of the second leg segment 167. A fourth actuator 217 connected between the second leg segment 167 and the third leg segment 213 is extendable and retractable to pivot the third leg segment 213 and attached foot 211 downward and upward relative to the second leg segment 167. The third leg segments 213 extend past the wheel and tire assemblies 110 to position the feet or pads 211 rearward of the wheel and tire assemblies 110 when the inner, distal and third leg segments 166, 167 and 213 extend horizontally relative to the undercarriage 145. Downward pivoting of the third leg segments 213 to lower the feet 211 below the wheel and tire assemblies 110 on rear leg assemblies 163 and 164 may be done to lift the wheel and tire assemblies 110 of the rear leg assemblies 163 and 164 off of the ground or a support surface to support the rear of the material handling machine 101 on the feet 211.

Figure 5:
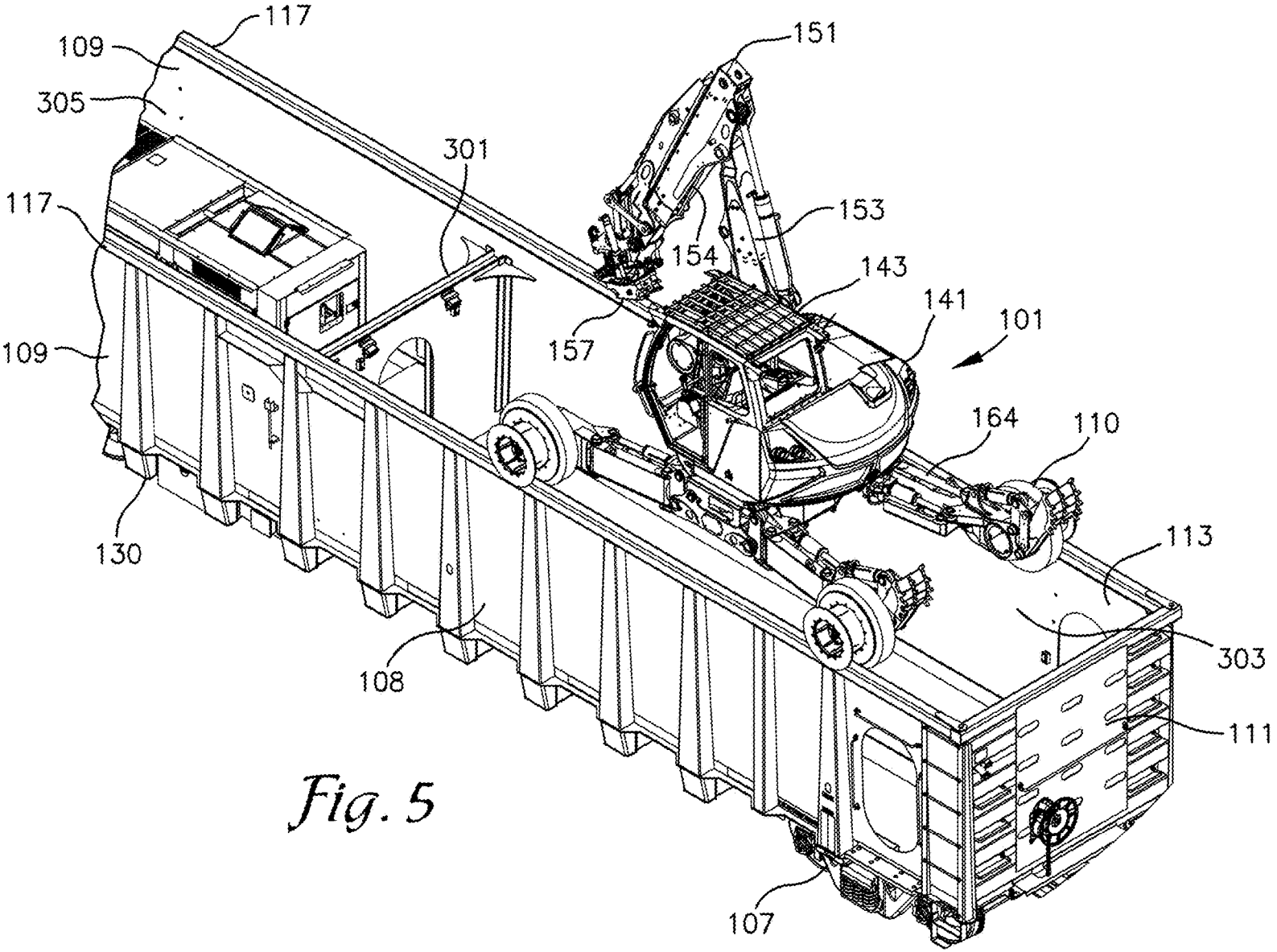
FIG. 5 is an enlarged view of the material handler storage car with the walking-type material handling machine supported thereon as in FIG. 4.
Figure 11:
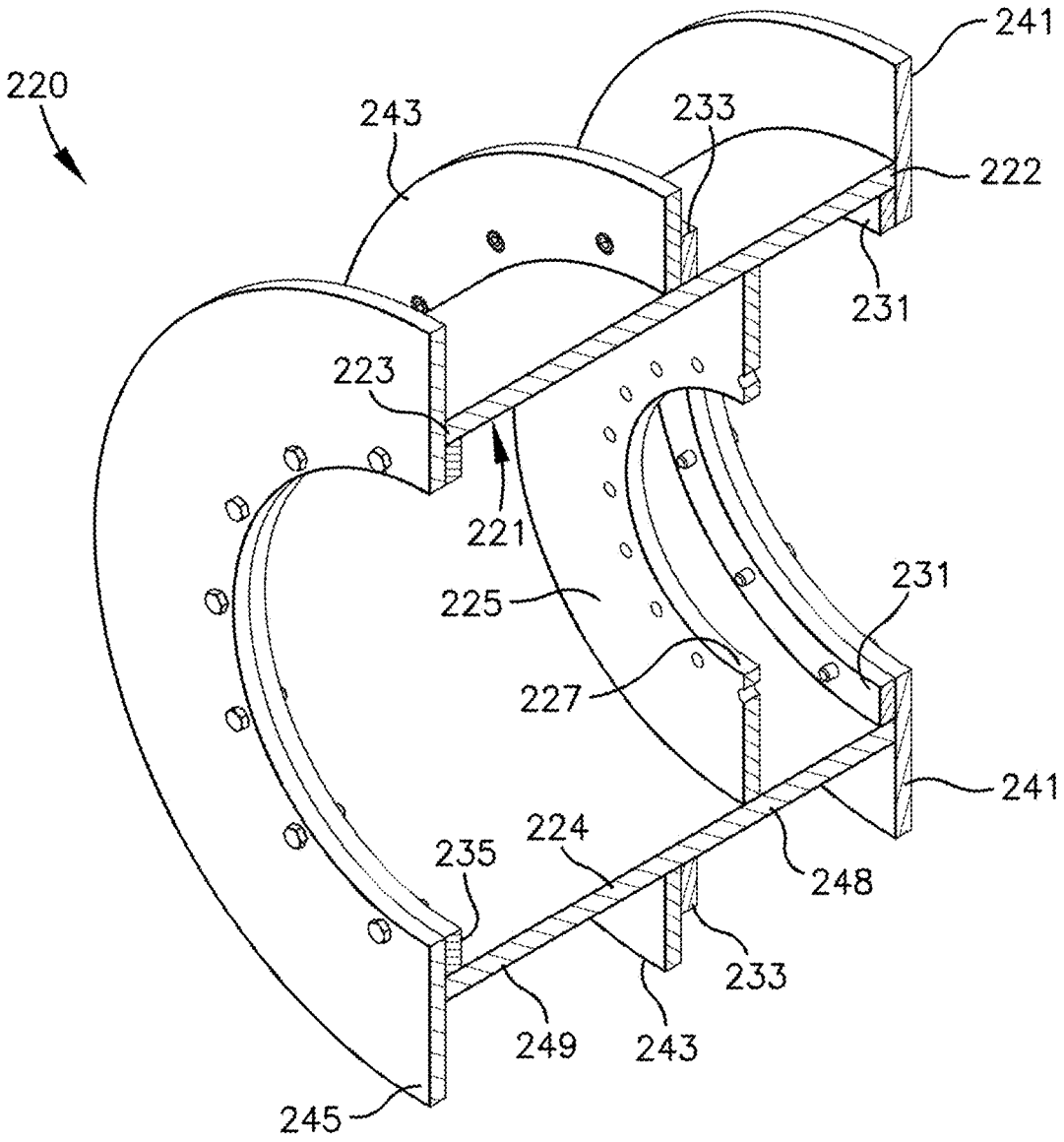
FIG. 11 is an enlarged, cross-sectional view of a wheel of the wheel and tire assembly as in FIGS. 8-10.

The modified wheel and tire assembly 110 is adapted to facilitate advancement of the material handling machine 101 along a road or the ground or along rails such as along the upper ends 117 of sidewalls 109 of a rail car as generally shown in FIG. 5. The modified wheel and tire assembly 110, a preferred embodiment of which is shown in FIGS. 8-11 includes a tire 218 mounted on a wheel 220. As best seen in FIGS. 9-11, the wheel 220 comprises a tubular, wheel body 221 having an inner end 222 and an outer end 223. In a preferred embodiment and as best shown in FIGS. 9-11, the wheel body 221 includes a circumferential, wheel body wall 224 formed of a monolithic or continuous construction. The wheel body wall 224 may also be described as being formed as a single piece or of single-piece construction. An inwardly projecting mounting flange 225, or wheel body mounting flange 225, projects radially inward from an inner surface of the wheel body 221. The radially inward projecting mounting flange 225 is spaced longitudinally between the inner end 222 and outer end 223 of the wheel body 221. The radially inward projecting mounting flange 225 circumscribes a hub receiving opening 227 sized to receive the rotating hub 203 of the wheel drive assembly 201 so that the mounting flange 225 on the wheel body 221 may pass over the rotating hub 203 and against the wheel mounting flange 207. Bolt holes (not shown) are formed in and through the radially inward projecting mounting flange 225 to enable bolting of the wheel body 221 to the wheel mounting flange 207 of the wheel drive assembly 201. The radially inward projecting mounting flange 225 may be welded to, integrally formed with or otherwise secured to the wheel body 221. The radially inward projecting mounting flange 225 may also be formed as a plurality of discontinuous lugs or tabs formed on or secured to and projecting radially inward from the inner surface of the wheel body 221.

An inner mounting flange 231 projects radially inward from or proximate the first or inner end 222 of the wheel body 221. The inner mounting flange 231 may be welded to, integrally formed with or otherwise secured to the wheel body 221 and may also project radially outward therefrom. The inner mounting flange 231 may also be formed as a plurality of discontinuous lugs or tabs formed on or secured to and projecting radially inward or outward from the wheel body 221 at the inner end 222 thereof.

A medial mounting flange 233 projects radially outward from the wheel body 221 medially between the inner end 222 and outer end 223 thereof and in longitudinally outward spaced relation from the first mounting flange 231. The medial mounting flange 233 may be welded to, integrally formed with or otherwise secured to the wheel body 221. The medial mounting flange 233 may also be formed as a plurality of discontinuous lugs or tabs formed on or secured to and projecting radially outward from the outer surface of the wheel body 221 medially between the inner and outer ends 222 and 223.

An outer mounting flange 235 is mounted on the outer end 223 of the wheel body 221 and projects radially inward therefrom. The outer mounting flange 235 may be welded to, integrally formed with or otherwise secured to the wheel body 221 and may also project radially outward therefrom. The outer mounting flange 235 may also be formed as a plurality of discontinuous lugs or tabs formed on or secured to and projecting radially inward or outward from the wheel body 221 at the outer end 222 thereof.

Inner and outer tire mounting rings 241 and 243 may be bolted to the inner and medial mounting flanges 231 and 233 to secure the tire 218 to the wheel body 221. Inner and outer tire mounting rings 241 and 243 may also be referred to as inner and outer wheel rims 241 and 243 and may be formed integral with wheel body 221, welded directly to the wheel body 221 or secured thereto by other connection means. A rail engaging ring or rail engaging flange 245 may be bolted to the outer mounting flange 235 so that the rail engaging flange 245 may be positioned to abut against an outer surface of the rails 117 formed by the upper ends of the rail car sidewalls 109 when the wheel and tire assembly 110 advances along the rail 117 as discussed in more detail hereafter. The rail engaging flange 245 may be formed integral with the wheel body 221 or welded to or otherwise secured to the wheel body 221 or the outer mounting flange 235.

The medial mounting flange 233 or outer wheel rim 243 divides the wheel 220 and wheel body 221 into an inner, tire mounting section 248 and an outer, rail engaging section 249. The tire mounting section 248 generally extends from the inner end 222 of the wheel body 221 to the medial mounting flange 233 or outer wheel rim 243. The rail engaging section 249 generally extends from the medial mounting flange 233 our outer wheel rim 243 to the outer end 223 of the wheel body 221.

In the embodiment shown and as best shown in FIG. 9, each tire 218 includes a tread 253 and first and second sidewalls 254 and 255 on opposite sides of the tread 253. Each sidewall 254 and 255 includes a distal sidewall section 256 and an inner sidewall section 257. Each distal sidewall section 256 extends between the tread 253 and the respective inner sidewall section 257. The inner sidewall section 257 is spaced longitudinally inward from the distal sidewall section 256 by a shoulder 258 and extends radially inward therefrom with an inner edge of each inner sidewall section 257 circumscribing an opening 259 through the sidewalls 254 and 255. The tire may be formed solid or hollow between the sidewalls 254 and 255 or with voids formed in or extending therethrough such as in a honeycomb type configuration. The tire 218 may be a pneumatic type tire formed hollow between the sidewalls 254 and 255 with beads formed along inner edges of the sidewalls 254 and 255 to facilitate inflation of the tire 218. When bolted to the inner and medial mounting flanges 231 and 233, the inner and outer tire mounting rings 241 and 243 extend in closely spaced or abutting relationship with the outer surfaces of the inner sidewall sections 257 of the first and second sidewalls 254 and 255 respectively to secure the tire 218 therebetween and to the wheel body 221. The sidewalls 254 and 255 may also be secured between fixed inner and outer rims 241 and 243, such as, for example, in a conventional pneumatic tire type assembly.

The tires 218 are adapted for supporting the material handling machine 101 as it travels across generally planar surfaces such as roads or floors. A preferred tire 218 for use with the wheel 220, is narrower than a wheel normally provided with the material handling machine 101 and the outer section 249 of the wheel body 221 extending between the medial mounting flange 233 and the rail engaging flange 245 is sized wide enough to permit the outer section 249 of the wheel body 221 to ride on top of the upper end 117 of a rail car sidewall 109 with the rail engaging flange 245 extending adjacent an outer face of the rail or upper end 117 of rail car sidewall 109 and the outer sidewall 255 of the tire 218 extending adjacent an inner face of the rail or upper end 117 of rail car sidewall 109 with the rail 117 extending or received within the space between the between the rail engaging flange 245 and outer sidewall 255 of the tire 218.

In an embodiment, the outer diameter of the wheel body 221 may be approximately twenty-four inches and the outer diameter of the rail engaging flange 245 may be approximately thirty two inches so that the length or height of the rail engaging flange 245 extending radially outward from the wheel body 221 is approximately four inches. The spacing between the rail engaging flange 245 and the outer tire mounting ring 243 secured to the medial mounting flange 233 may be approximately ten and one-half inches. The spacing between the medial mounting flange 233 and the inner tire mounting ring 241 may be approximately nine and one-half inches. The width of the tire 218 across the distal sidewall sections 256 is shown wider than the spacing between the outer faces of the inner and outer tire mounting rings 241 and 243.

Openings through the inner mounting flange 231 and the inner tire mounting ring 241 are wider in diameter than the portion of the wheel drive base 205 around which they extend to permit the inner mounting flange 231 and inner tire mounting ring 241 to rotate freely around the wheel drive base 205. An opening through the outer mounting ring 243 and the rail engaging flange 245 is provided to permit access to the inner wheel body mounting flange 225 to facilitate bolting of the inner wheel body mounting flange to the mounting flange 207 on the rotating hub 203.

Figure 6:
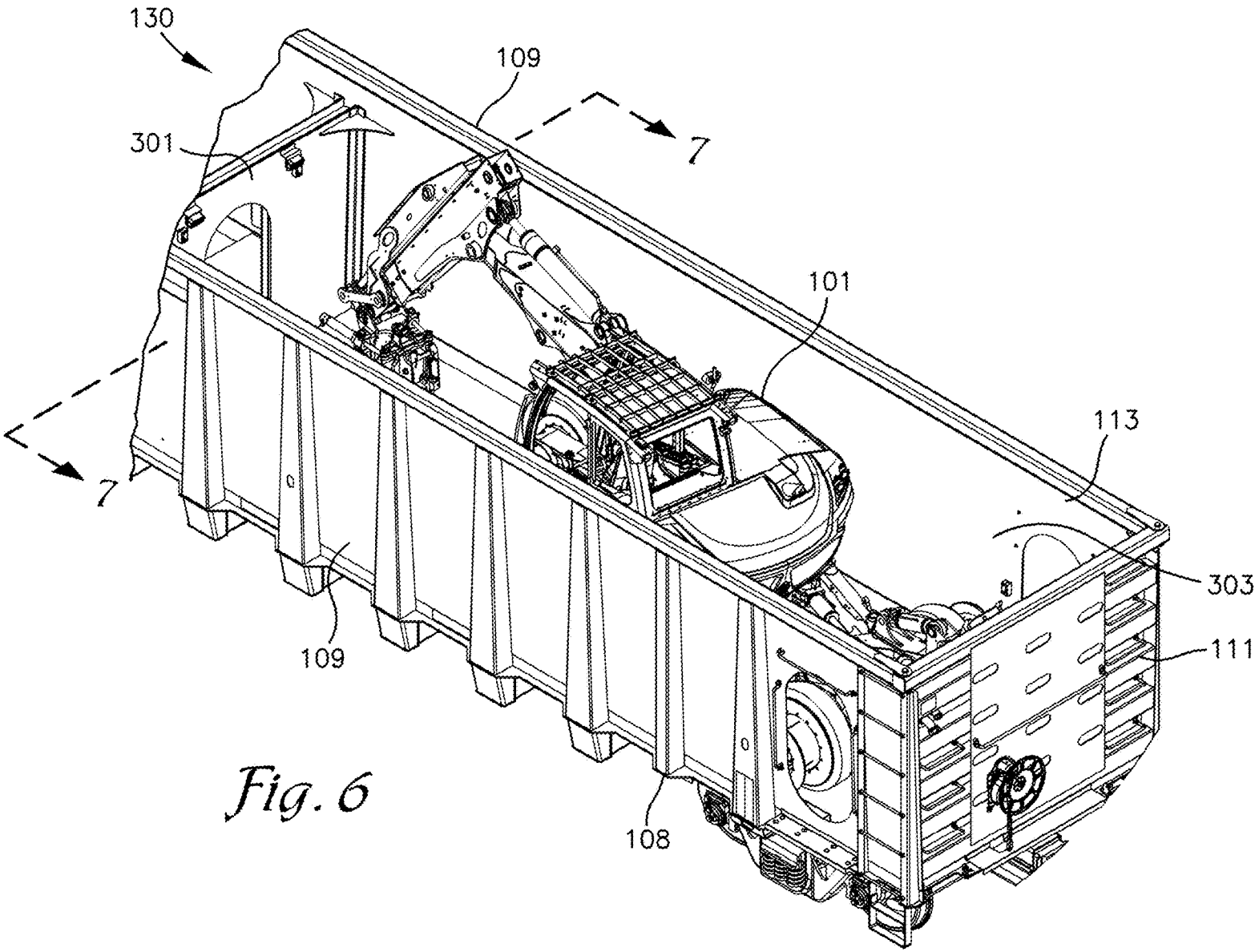
FIG. 6 is a view similar to FIG. 5 showing the walking-type material handling machine lowered into an interior space of the material handler storage car.
Figure 7:
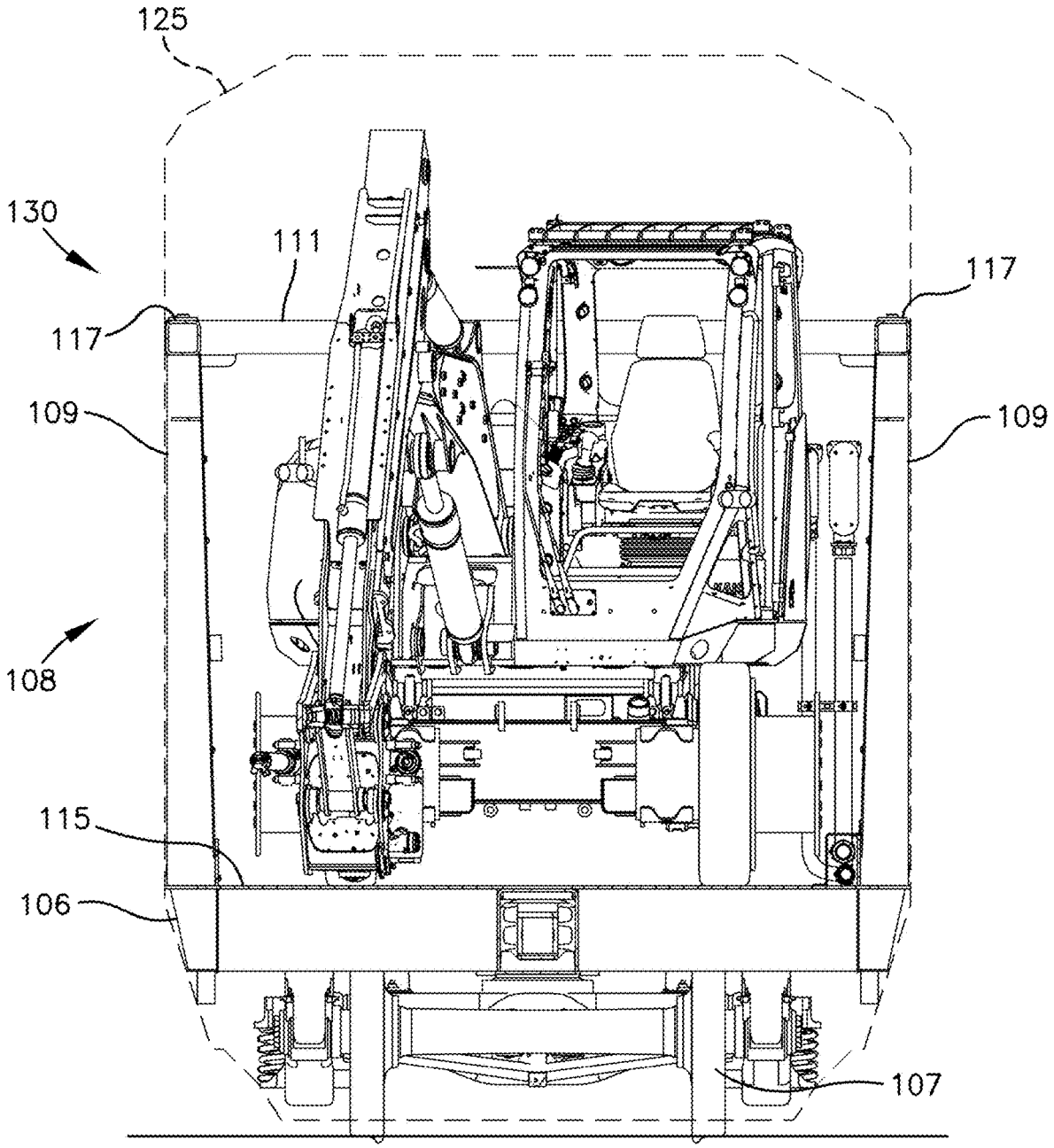
FIG. 7 is an enlarged, cross-sectional view taken along line 7-7 of FIG. 6.

Referring to FIGS. 4-7 one of the open topped rail cars 130 may be configured for storing the material handling machine 101 within the sidewalls 109 thereof and may be referred to as the material handler storage car 130. In the embodiment shown, a partition or dividing wall 301 extends across the interior space 113 of the material handler storage car 130 from sidewall 109 to sidewall 109 dividing the interior space 113 into a material handling machine storage section 303 and an auxiliary equipment storage section 305. Using the articulated boom 151, an operator of the material handling machine 101 can selectively lift the jointed leg assemblies 161-164 to raise the associated wheel and tire assembly 110 off of the respective sidewalls 109, then pivot the leg assemblies 161-164 inward and downward in a selected order until all of the wheel and tire assemblies 110 rest on the floor of the material handler storage car 130 or on support structure included within the interior space 113 of the car 130 as shown in FIGS. 6 and 7. The material handling machine 101 may be lowered into the car 130 such that at least a portion of the cab 143 of the material handling machine 101 extends within the interior space 113 and the entire material handling machine 101, including the articulated boom 151, fits within an established dimensional envelope 125 or clearance diagram such as the clearance diagram set by the American Association of Railroads as generally shown in FIG. 7. The boom 151 and leg assemblies 161-164 may be operated to lift the material handling machine 101 from the interior space 113 to position the outer section 249 of the wheel body 221 of each wheel and tire assembly 110 on the upper end 117 of a sidewall 109 of the material handler storage car 130 so that the material handling machine 101 may advance along the sidewalls 109. The operator may then selectively manipulate the boom 151 and leg assemblies 161-164 to permit the material handling machine 101 to advance across the gaps between adjacent rail cars 130 and 103 and onto the upper ends 117 of the sidewalls 109 of adjacent rail cars 103.

A variety of tools, such as grapple 158, which are removably attachable to the articulated boom 151, may be stored on the consist 102 including in the auxiliary equipment storage section 305 of the material handler storage car 130. An operator may then select the appropriate tool for a desired task to be completed in association with moving, engaging or otherwise affecting material or equipment on the rail cars 103 or 130 including loading material onto or off of the rail cars 103 and 130.

In the embodiment shown, a grapple type tool 158 as shown in FIG. 12 may be used for releasably grasping one or more rail ties 122 to selectively discharge rail ties 122 from the consist 102 to supplement ties discharged using the rail tie singulating and discharge equipment 120 or to dislodge a rail tie 122 that has become stuck or jammed relative to the equipment 120 or move rail ties 122 from one car 103 to another. The material handling machine 101 could be used on a consist of open topped rail cars carrying other materials such as ballast or rail tie plates to be distributed along a section of track or for hauling away material removed from a section of track. A jack hammer type tool could be removably connected to the tool coupler 157 for breaking up clumps of frozen ballast to facilitate discharge through gates in the bottom of the cars 103 in which the ballast is carried. A bucket type tool may be connected to the tool coupler 157 to facilitate emptying cars 103 of ballast, gravel, top-soil, snow or similar materials. A magnetic head may be selectively and removably attached to the tool coupler 157 to facilitate emptying or filling open top cars with metal parts including rail tie plates or spikes. Saws, shears or other brush removal tools may be selectively and removably coupled to the tool coupler 157 for use in clearing brush along a railroad right of way.

It is to be understood that while certain forms of the present invention have been illustrated and described herein, it is not to be limited to the specific forms or arrangement of parts described and shown.

What is claimed and desired to be secured by Letters Patent is as follows:

1. A wheel and tire assembly securable to a rotating hub of a wheel base including:

a tire having a tread and first and second tire sidewalls, the first and second tire sidewalls each having an inner edge circumscribing a tire opening extending through the first and second tire sidewalls; and a wheel body comprising a tubular wheel body wall having a first end and a second end wherein the tire is securable to and around the wheel body with the tubular wheel body wall extending through the tire opening, the wheel body further having a rail engaging flange projecting radially outward relative to the wheel body wall in outwardly spaced relation from the tire in a spacing adapted for reception of a rail therebetween, wherein a wheel mounting flange projects radially outward from the rotating hub of the wheel base and the wheel and tire assembly includes a wheel body mounting flange projecting inward from the wheel body wall between the first end and the second end of the wheel body and the wheel body mounting flange is removably securable to the wheel mounting flange of the rotating hub.

2. The wheel and tire assembly as in claim 1 wherein the tubular wheel body wall is formed as a single piece.

3. The wheel and tire assembly as in claim 1 wherein the tire is secured to and around the wheel body between a first rim and a second rim.

4. The wheel and tire assembly as in claim 1 wherein a first rim extends outward around the wheel body proximate the first end of the wheel body and a second rim extends outward around the wheel body medially between the first end and the second end of the wheel body.

5. A walking type material handling machine having four jointed legs with each jointed leg having a wheel drive assembly mounted on a distal end of each jointed leg and with each wheel drive assembly including a hub rotatably mounted on the respective jointed leg, wherein one of the wheel and tire assemblies of claim 1 is attached to the hub of each wheel drive assembly.

6. The walking type material handling machine as in claim 5 wherein each of the wheel and tire assemblies is attached to the hub of a respective wheel drive assembly such that the first end of the wheel body extends toward the respective jointed leg to which the respective wheel drive assembly is attached and the second end of the wheel body extends away from the respective jointed leg.

7. The walking type material handling machine as in claim 5 wherein the four jointed legs are pivotably connected to an undercarriage having a power and control unit rotatably mounted on the undercarriage and an articulated arm pivotally connected to the power and control unit.

8. The walking type material handling machine as in claim 5 in combination with a consist of open topped rail cars wherein upper ends of the sidewalls of the open topped rail cars form rails which extend between the rail engaging flange and the tire secured to the wheel body of each wheel and tire assembly as the wheel and tire assembly is advanced across the upper ends of the sidewalls.

9. A wheel and tire assembly securable to a rotating hub of a wheel base including:

a tire having a tread and first and second tire sidewalls, the first and second tire sidewalls each having an inner edge circumscribing a tire opening extending through the first and second tire sidewalls; and a wheel body comprising a tubular wheel body wall formed as a single piece and having an inner end and an outer end, the wheel body having an inner rim extending radially outward relative to the wheel body proximate the inner end and an outer rim extending radially outward relative to the wheel body medially between the inner end and the outer end of the wheel body wherein the tire is secured to and around the wheel body between the inner rim and the outer rim, the wheel body further having a rail engaging flange projecting radially outward relative to the wheel body wall in outwardly spaced relation from the outer rim in a spacing adapted for reception of a rail therebetween.

10. The wheel and tire assembly as in claim 9 wherein a wheel mounting flange projects radially outward from the rotating hub of the wheel base and the wheel and tire assembly includes a wheel body mounting flange projecting inward from the wheel body wall between the inner end and the outer end of the wheel body and the wheel body mounting flange is removably securable to the wheel mounting flange of the rotating hub.

11. A walking type material handling machine having four jointed legs with each leg having a wheel drive assembly mounted on a distal end of each jointed leg and with each wheel drive assembly including a rotating hub rotatably mounted on a wheel base connected to the respective jointed leg, wherein one of the wheel and tire assemblies of claim 9 is attached to the rotating hub of each wheel drive assembly with the inner end of the wheel body extending toward the respective jointed leg to which the respective wheel drive assembly is attached and the outer end of the wheel body extending away from the respective jointed leg.

12. The walking type material handling machine as in claim 11 wherein the four jointed legs are pivotably connected to an undercarriage having a power and control unit rotatably mounted on the undercarriage and an articulated arm pivotally connected to the power and control unit.

13. The walking type material handling machine as in claim 12 in combination with a consist of open topped rail cars wherein upper ends of the sidewalls of the open topped rail cars form rails which extend between the rail engaging flange and the tire secured to the wheel body of each wheel and tire assembly as the wheel and tire assembly is advanced across the upper ends of the sidewalls.

14. The wheel and tire assembly as in claim 10 wherein the rail engaging flange is positioned on the outer end of the wheel body.

15. The wheel and tire assembly as in claim 9 wherein a wheel mounting flange projects radially outward from the rotating hub of the wheel base and the wheel and tire assembly includes a wheel body mounting flange projecting inward from the wheel body wall between the inner rim and the outer rim of the wheel body and the wheel body mounting flange is removably securable to the wheel mounting flange of the rotating hub.

16. The wheel and tire assembly as in claim 15 wherein the rail engaging flange is positioned on the outer end of the wheel body.

17. A wheel and tire assembly securable to a rotating hub of a wheel base including:

a tire having a tread and first and second tire sidewalls, the first and second tire sidewalls each having an inner edge circumscribing a tire opening extending through the first and second tire sidewalls; and a wheel body comprising a tubular wheel body wall formed as a single cylindrical piece and having an inner end and an outer end, the wheel body having an inner rim extending radially outward relative to the wheel body proximate the inner end and an outer rim extending radially outward relative to the wheel body medially between the inner end and the outer end thereof wherein the tire is secured to and around the wheel body between the inner rim and the outer rim, the wheel body further having a rail engaging flange projecting radially outward relative to the wheel body wall in outwardly spaced relation from the outer rim in a spacing adapted for reception of a rail therebetween.

* * * * *